US010838364B2

(12) United States Patent
Winkler et al.

(10) Patent No.: US 10,838,364 B2
(45) Date of Patent: Nov. 17, 2020

(54) MECHANICAL TIMEPIECE OSCILLATOR WHICH IS ISOCHRONOUS IN ALL POSITIONS

(71) Applicant: ETA SA Manufacture Horlogere Suisse, Grenchen (CH)

(72) Inventors: Pascal Winkler, St-Blaise (CH); Laurent Klinger, Bienne (CH); Jean-Luc Helfer, Le Landeron (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 16/386,308

(22) Filed: Apr. 17, 2019

(65) Prior Publication Data

US 2019/0361398 A1 Nov. 28, 2019

(30) Foreign Application Priority Data

May 25, 2018 (EP) ..... 18174332

(51) Int. Cl.

| | |
|---|---|
| ***G04B 17/10*** | (2006.01) |
| ***G04B 17/32*** | (2006.01) |
| ***G04B 31/06*** | (2006.01) |
| ***G04C 3/10*** | (2006.01) |

(52) U.S. Cl.

CPC ..... *G04B 17/10* (2013.01); *G04B 17/32* (2013.01); *G04B 31/06* (2013.01); *G04C 3/102* (2013.01)

(58) Field of Classification Search

CPC ..... G04B 17/10; G04B 17/32; G04B 17/045; G04B 31/06; G04C 3/102

See application file for complete search history.

(56) References Cited

U.S. PATENT DOCUMENTS

| | | | | |
|---|---|---|---|---|
| 3,277,394 | A | 10/1966 | Holt et al. | |
| 3,318,087 | A | 5/1967 | Favre | |
| 2015/0234354 | A1 | 8/2015 | Henein et al. | |
| 2018/0136607 | A1* | 5/2018 | Lechot | G04B 17/045 |
| 2018/0143591 | A1* | 5/2018 | Di Domenico | G04B 13/026 |

FOREIGN PATENT DOCUMENTS

| | | |
|---|---|---|
| EP | 2 273 323 A2 | 1/2011 |
| EP | 2 911 012 A1 | 8/2015 |
| EP | 3 276 431 A1 | 1/2018 |

OTHER PUBLICATIONS

European Search Report dated Nov. 30, 2018 in European Application 18174332.9, filed on May 25, 2018 (with English Translation of Categories of Cited Documents b Written Opinion).

* cited by examiner

*Primary Examiner* — Jeffrey M Shin

(74) *Attorney, Agent, or Firm* — Oblon, McClelland, Maier & Neustadt, L.L.P.

(57) ABSTRACT

A mechanical oscillator with an inertia element oscillating about a virtual pivot axis of fixed position with respect to a fixed base to which it is suspended by several flexible connections, each including a deformable compass-like member including elastic strips forming a first arm fixed to a base and a second arm fixed to the inertia element, joined at a reversal edge defining a apex of the deformable compass-like member, wherein in an unstressed rest state of the oscillator, the projection of the apex is on a first side of the pivot axis, opposite to a second side where the ends of the first and second arms are projected.

29 Claims, 5 Drawing Sheets

MECHANICAL TIMEPIECE OSCILLATOR WHICH IS ISOCHRONOUS IN ALL POSITIONS

CROSS-REFERENCE TO RELATED APPLICATION

This application claims priority to European Patent Application No. 18174332.9 filed on May 25, 2018, the entire disclosure of which is hereby incorporated herein by reference.

FIELD OF THE INVENTION

The invention concerns a mechanical timepiece oscillator comprising at least one base arranged to be secured to a bottom plate or a bridge of a timepiece movement, and at least one inertia element arranged to oscillate about a virtual pivot axis of fixed position with respect to said at least one base or of fixed position with respect to said bases when said oscillator has several, in a plane of pivoting perpendicular to said virtual pivot axis, each said inertia element being suspended to at least one said base by several flexible connections each including at least one elastic strip, and said flexible connections together defining said virtual pivot axis.

The invention also concerns a timepiece movement including at least one such mechanical oscillator and including a bottom plate or a bridge for securing each said base comprised in each said oscillator.

The invention also concerns a watch including at least one such timepiece movement and/or including at least one such mechanical oscillator.

The invention concerns the field of high precision timepieces, very insensitive to external physical parameters, comprising oscillators with elastic strips, having a high quality factor and maintaining high isochronism qualities in all positions of wear.

BACKGROUND OF THE INVENTION

The most recent work on timepiece oscillators has offered different types of flexible connections, for the pivoting and return of balances.

Without going into detail, it will be noted that two conditions absolutely must be fulfilled in order to use these oscillators in watches:

rate must be as independent as possible of oscillation amplitude, although compensation for loss can be made at the escapement;

rate must be independent of the orientation of the watch in the field of gravity.

Various disclosures consider that these two indispensable characteristics are ensured, but simulations and tests carried out in fact demonstrate shortcomings, in particular in certain positions of wear, where the expected results cannot be obtained.

Current disclosures generally have a drawback that limits their application on an industrial scale, and which consists of the very low possible oscillation amplitude value, typically up to only 10° or 15°. This limit is explained either because it is impossible to go higher due to stresses in the strips forming the flexible connections, or because at least one of the two conditions set out above (rate independent of amplitude and rate independent of orientation of the watch in the field of gravity) is no longer satisfied.

European Patent Application No. EP3299905 in the name of CSEM proposes a solution which allows higher amplitudes to be achieved, typically 30°, which constitutes real progress. However, rate is not yet independent of the orientation of the watch in the field of gravity, in particular in the positions X+, X−, Y+, Y−, in which rate characteristics as a function of amplitude are similar to each other, but very far from the rate characteristic as a function of amplitude corresponding to the horizontal position, perpendicular to the field of gravity, which is excellent.

European Patent Application No EP3276431A1 in the name of CARTIER INT discloses a mechanical oscillator including a balance without pivots comprising a rim located in a first plane and an anchoring member able to be fixed to a non-oscillating part of the timepiece movement and at least two springs each connecting the balance to the anchoring member. The anchoring member is coaxial to the balance. At least a main part of each spring extends, in a non-elastically deformed position, out of the first plane or a plane parallel to this first plane. Each spring is secured by a first end to the anchoring member and by a second end to the balance. The points of attachment of the first ends of the springs tp the anchoring member are located outside the first plane.

U.S. patent application Ser. No. 32/773,94A in the name of HOLT discloses a temperature compensated electromechanical resonator, which includes two coaxial parallel rings suspended with respect to a common structure by flexible elements made of a material that compensates for temperature effects, and including means for making the two rings resonate simultaneously and in opposite directions. The points of attachment between the flexible elements and the rings, and between the flexible elements and the structure, are at the same radial distance from the axis of oscillation of the rings.

U.S. patent application Ser. No. 33/180,87A in the name of ROBERT FAVRE (MOVADO) similarly discloses a torsion oscillator with two coaxial and parallel inertia masses, suspended to a plurality of elements each including zig-zag flexible strips in a plane passing through the axis of oscillation of the inertia masses.

EP Patent Application No 2911012A1 in the name of CSEM discloses a rotary oscillator for timepieces comprising a support element to allow assembly of the oscillator in a timepiece, a balance, a plurality of flexible strips connecting the support element to the balance and capable of exerting a return torque on the balance wheel, and a rim mounted integrally with the balance. The plurality of flexible strips comprises at least two flexible strips including a first strip disposed in a first plane perpendicular to the plane of the oscillator, and a second strip disposed in a second plane perpendicular to the plane of the oscillator and secant with the first plane. The geometric axis of oscillation of the oscillator is defined by the intersection of the first plane and the second plane, this geometric axis of oscillation crossing the first and second strips at seven eighths of their respective length.

EP Patent Application No. 2273323A2 in the name of ULYSSE NARDIN discloses a mechanical oscillator oscillating about an axis of oscillation without pivots, said oscillator including a rim centred on the axis of oscillation and mounted on a first attachment portion located on the axis of oscillation, an attachment portion intended to be secured to a frame of a timepiece movement, and a plurality of elastic systems connecting the rim and the attachment portion. At least some of the elastic systems are suspended and are free with respect to the frame.

SUMMARY OF THE INVENTION

The invention proposes to develop a mechanical oscillator with flexible connections suitable for high amplitude, and typically up to at least 25°, and which, in the vertical wear positions have rate characteristics as a function of amplitude equivalent to that measured in the horizontal position.

To this end, the invention concerns a mechanical timepiece oscillator.

The invention also concerns a timepiece movement.

The invention also concerns a watch.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
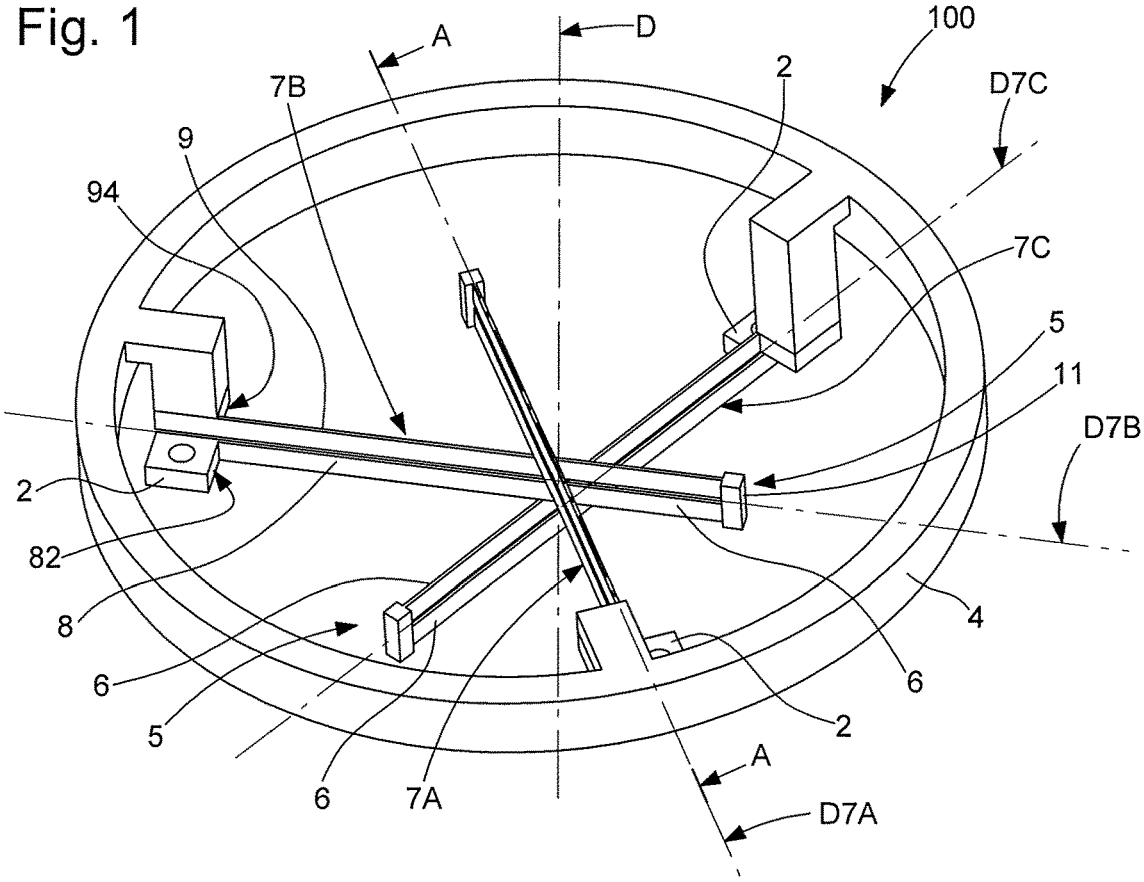
FIG. 1 represents a schematic, perspective, top view of an oscillator according to the invention, in a particular and non-limiting embodiment wherein a single inertia element is suspended to bases fixed to the structure of a movement by three flexible connections having similar characteristics, together defining the virtual pivot axis of the inertia element, and superposed in different levels parallel to a plane of pivoting of the inertia element, perpendicular to the virtual pivot axis.

The difficulty of the issue raised above is to determine a geometry for the flexible strips of the oscillator, which provides a solution that satisfies the two conditions that rate is independent of amplitude and rate is independent of the orientation of the watch in the field of gravity, while having an amplitude that allows industrial use, typically more than 25°, and preferably from around 30° to 40°, or even higher.

The invention concerns a mechanical timepiece oscillator 100, which includes at least one base 2 arranged to be attached to a bottom plate 3 or a bridge of a timepiece movement 200. This oscillator 100 includes at least one inertia element 4, which is arranged to oscillate about a virtual pivot axis D of fixed position relative to this base 2 if there is only one, or relative to these bases 2 when oscillator 100 has several, in a plane of pivoting P perpendicular to virtual pivot axis D.

Each inertia element 4 is suspended to at least one such base 2 by several flexible connections 5 each including at least one elastic strip 6. These flexible connections 5 together define virtual pivot axis D, in their particular geometric arrangement, in projection onto the plane of pivoting P of inertia element 4.

Firstly, the present invention endeavours to avoid any configuration wherein the inertia mass of the oscillator, typically a balance, includes stiff arms extending from the rim to an inner support element of elastic strips 6 forming flexible connections 5. To this end, the invention prefers the configuration wherein elastic strips 6 are secured to the rim of inertia element 4 on the one hand, and to the frame (bottom plate or bridge of the movement) on the other hand at a fixed base 2, by the end thereof located on the external diameter, i.e. farthest from virtual pivot axis D defined by flexible connections 5.

Next, the invention prefers the strips to cross, evidently in projection onto plane of pivoting P, since these elastic strips 6 are arranged on different, parallel levels, at pivot axis D. Naturally, this configuration of the invention requires superposition on more levels than in the prior art, but can also accommodate reduced strip dimensions, which does not adversely affect the overall volume, which is preferably inscribed within the volume of inertia element 4 itself.

According to the invention, at least one such flexible connection 5 includes at least one deformable compass-like member 7.

The term 'compass' is chosen to describe, in a simple manner, a component which is preferably in one-piece and which includes, on either side of a compass top, deformable arms, which are attached to different components of the oscillator; this deformable compass is not hinged, it is actually similar to a divining rod. For the sake of simplification, the invention is illustrated with a single arm on each side of the compass top, but it is entirely possible to envisage fitting the deformable compass with a plurality of arms, at least on one side of its top, since the number of arms on each side of the top may be different.

More particularly, this deformable compass 7 includes such an elastic strip 6 forming a first arm 8, which is arranged, at a first external end 82, to be fixed to such a base 2, or integral with a said base 2, especially in a one-piece embodiment. This first arm 8 is angularly movable, in projection onto plane of pivoting P, with respect to another elastic strip 6, which forms a second arm 9 of deformable compass 7. At a second external end 94, this second arm 9 is arranged to be fixed to inertia element 4 or is integral with inertial element 4. First arm 8 and second arm 9 of each deformable compass 7 are joined at a reversal edge 11, which defines a virtual apex 10 of deformable compass 7.

It is understood that the arms of this compass are deformed during oscillation. Typically, particular arms, which are straight in the rest position of the oscillator, take a substantially arcuate shape of variable radius during oscillation, during which the apex 10 of deformable compass 7 is movable relative to virtual pivot axis D, from which it is furthest away in the rest position of oscillator 100.

According to the invention, the projection onto plane of pivoting P of virtual apex 10 is on a first side of virtual pivot axis D, opposite a second side where first end 82 and second end 94 are projected. In short, the geometric field covered by elastic strips 6 during oscillation intersects virtual pivot axis D. A straight line forms a compass axis D7 joining virtual pivot axis D and the projection of virtual apex 10 onto plane of pivoting P. In an unstressed rest state of oscillator 100, the projection of virtual apex 10 onto a plane defined by virtual pivot axis D and compass axis D7 is on a first side of virtual pivot axis D, opposite to a second side where first end 82 and second end 94 are projected.

More particularly, the angle formed by the projection, onto plane of pivoting P, of virtual apex 10, of virtual pivot axis D and of first end 82 and/or of second end 94, is comprised between 160° and 200°.

Figure 2:
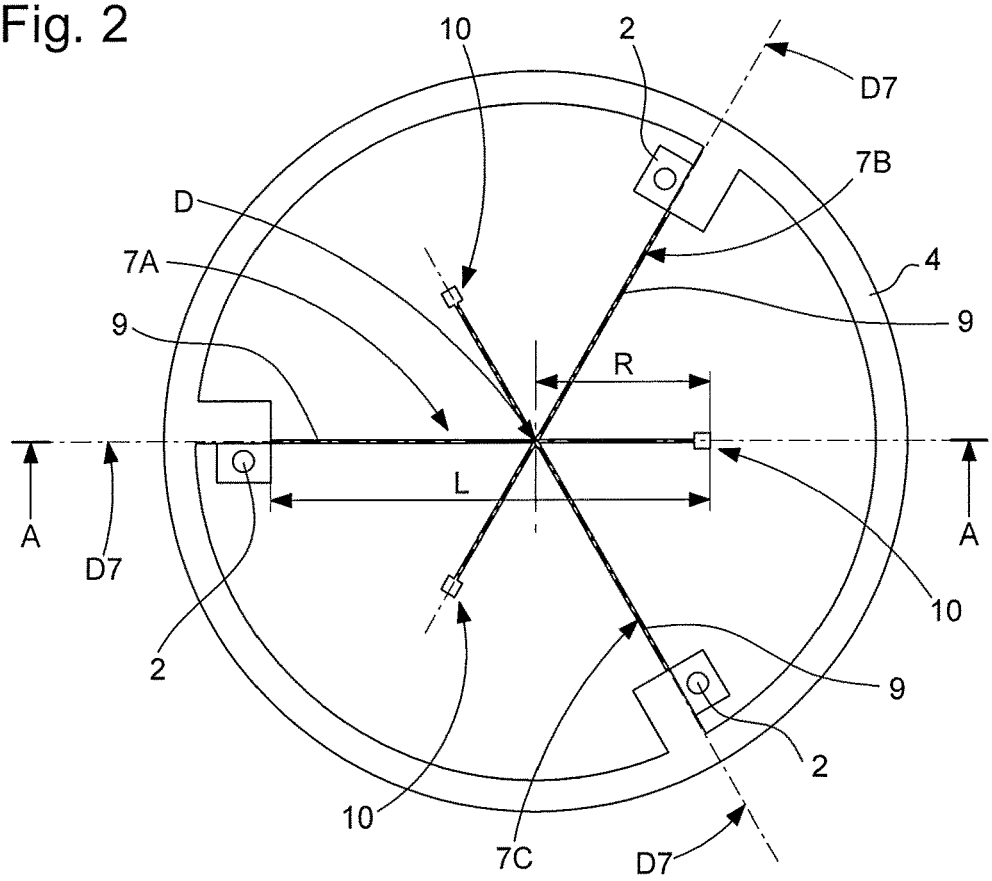
FIG. 2 represents a schematic top view of the oscillator of FIG. 1.
Figure 3:
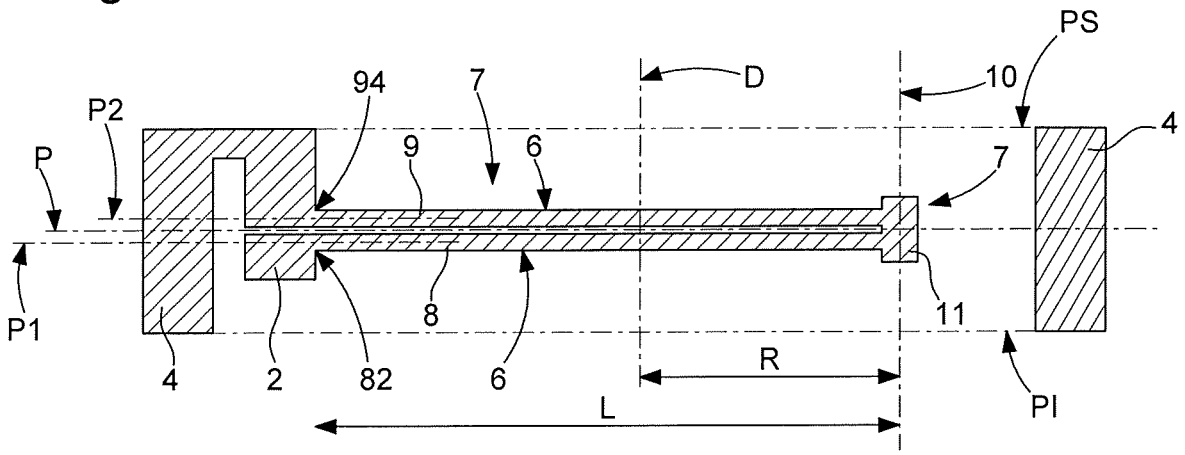
FIG. 3 is a section along a plane AA, taken through the pivot axis, of an oscillator according to FIG. 1 or 2, the sectional plane passing through two elastic strips which together form a deformable compass-like member, comprised in the flexible connections of this oscillator, in a particular variant wherein the compass arms formed by these two elastic strips, which are in two superposed levels parallel to the plane of pivoting, have usable lengths, between their point of attachment and a virtual apex of the compass at a reversal, which are equal. In this variant, the inertia element extends on both sides of the set of elastic strips.

More particularly, as seen in the embodiments of FIGS. 1 to 3, the projections onto plane of pivoting P of first end 82 and of second end 94 coincide.

More particularly still, in an unstressed rest state of oscillator 100, first arm 8 and second arm 9 are symmetrical, in projection onto plane of pivoting P, with respect to a straight line forming a compass axis D7 joining virtual pivot axis D and the projection of virtual apex 10. This projection of virtual apex 10 is located on a first side of virtual pivot axis D, opposite a second side where first end 82 and second end 94 are projected. During operation of oscillator 100, each deformable compass 7 thus forms a V, whose arms are attached externally to the base and to the inertia element, and whose tip (the apex) is free. Preferably, in the rest position of the oscillator, the V is closed, and first arm 8 and second arm 9 are superposed.

Preferably, the ratio R/L between, on the one hand, the eccentricity R of apex 10 relative to virtual pivot axis D, in projection onto plane of pivoting P, and on the other hand, the shortest length L between apex 10 and first end 82 or second end 94, in projection onto plane of pivoting P, is comprised between 0.12 and 0.18, or between 0.47 and 0.53. More particularly, the lengths L between apex 10 and first end 82 on the one hand and second end 94 on the other hand, in projection onto plane of pivoting P, are equal, as seen in FIG. 3.

In particular, all the compass axes D7 of all the deformable compasses 7 comprised in a same flexible connection 5 are coincident in projection onto plane of pivoting P.

In particular, all the compass axes D7 of all the deformable compasses 7 comprised in flexible connections 5 intersect, in projection onto plane of pivoting P, on virtual pivot axis D.

More particularly still, all the flexible connections 5 are identical.

In particular, all the compass axes D7 of all the deformable compasses 7 comprised in flexible connections 5 are uniformly angularly distributed about virtual pivot axis D.

In a particular embodiment, at least one deformable compass 7 has straight elastic strips 6. More particularly, all the elastic strips 6 are straight.

Preferably, but not exclusively, at least one deformable compass 7 has first arm 8 in a first level P1 parallel to plane of pivoting P, and second arm 9 in a second level P2 parallel to plane of pivoting P and distinct from first level P1. It is possible to arrange this oscillator with warped strips; however, this increases the complexity and dimensions, with no apparent advantage. More particularly, each deformable compass 7 has first arm 8 in a first level P1 parallel to plane of pivoting P and said second arm 9 in a second level P2 parallel to plane of pivoting P and distinct from first level P1.

Advantageously, at least one deformable compass 7 has a first arm 8 and a second arm 9 whose projections onto plane of pivoting P, in the unstressed rest state of oscillator 100, are superposed on each other. More particularly, the projections of first arm 8 and of second arm 9 onto plane of pivoting P, in the unstressed rest state of oscillator 100 are identical to each other.

Figure 8:
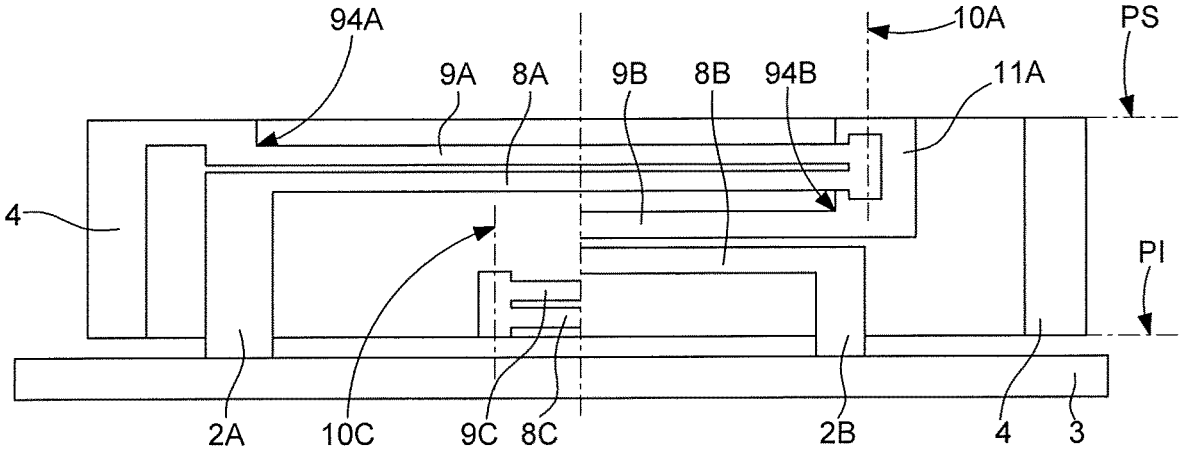
FIG. 8 is a section through plane AA, passing through the pivot axis, of an oscillator according to FIG. 1 or 2, showing the superposition of the three levels of flexible strips, each extending over two parallel levels.

In particular, and as seen in FIGS. 3 and 8, at least one inertia element 4 extends, in the direction of virtual pivot axis D, on both sides of the set of flexible connections 5 via which it is suspended to base 2 or to bases 2, between an upper plane PS and a lower plane Pl. More particularly, each inertia element 4 extends in the direction of virtual pivot axis D on both sides of the set of flexible connections 5 via which it is suspended to base 2 or to bases 2.

Advantageously, at least one inertia element 4 is devoid of an axial bearing, and is devoid of a radial bearing, with respect to virtual pivot axis D, other than flexible connections 5 via which it is suspended to base 2 or to bases 2. More particularly, each inertia element 4 is devoid of an axial bearing, and devoid of a radial bearing, with respect to virtual pivot axis D, other than flexible connections 5 via which it is suspended to base 2 or to bases 2.

In a particular embodiment, at least one deformable compass 7 includes at least one intermediate inertia block, stiffer than first arm 8 and second arm 9, on first arm 8 and/or on second arm 9 and/or on reversal edge 11. However, an inertia block at reversal edge 11 seems superfluous; the variant illustrated by the Figures is limited to providing the mechanical joint between first arm 8 and second arm 9.

Figure 9:
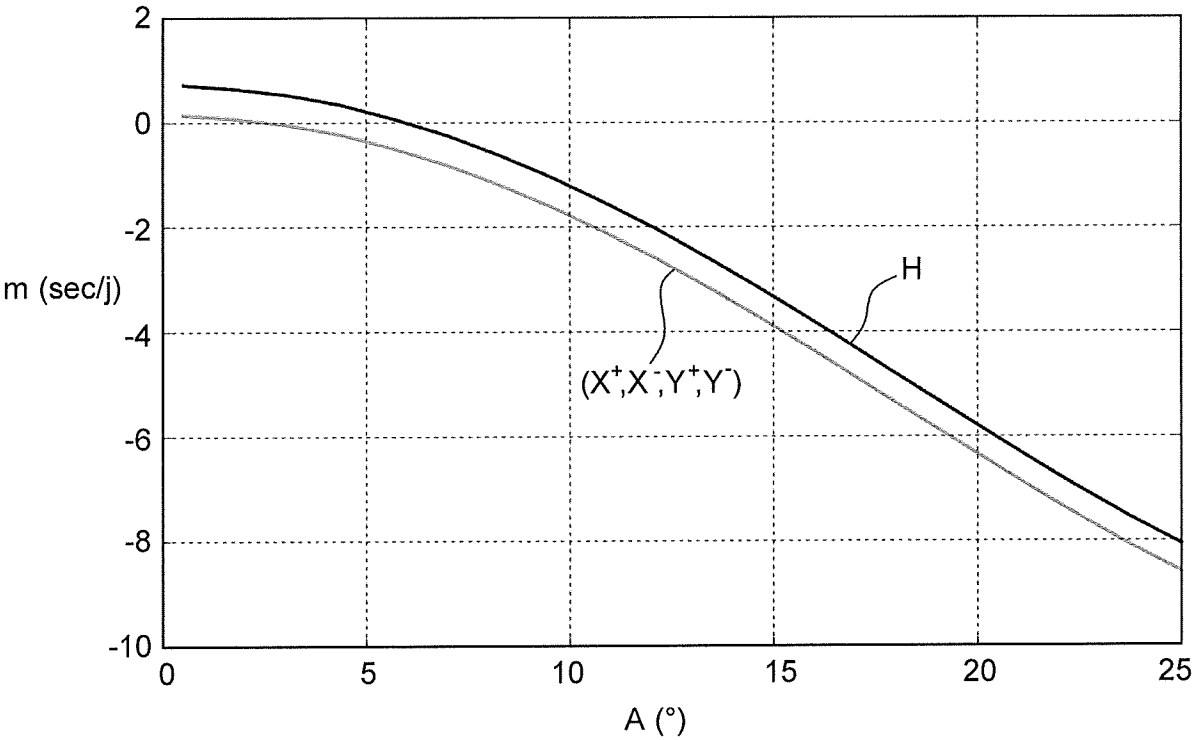
FIG. 9 is a rate diagram, with the rate in seconds per day on the ordinate, as a function of amplitude in degrees on the abscissa, the upper curve corresponds to rate in the horizontal plane, and the lower curve, very close to the preceding curve, which results from superposition of the rate curves in a vertical plane for four different orientations in gravity X+, X−, Y+, Y−.
Figure 10:
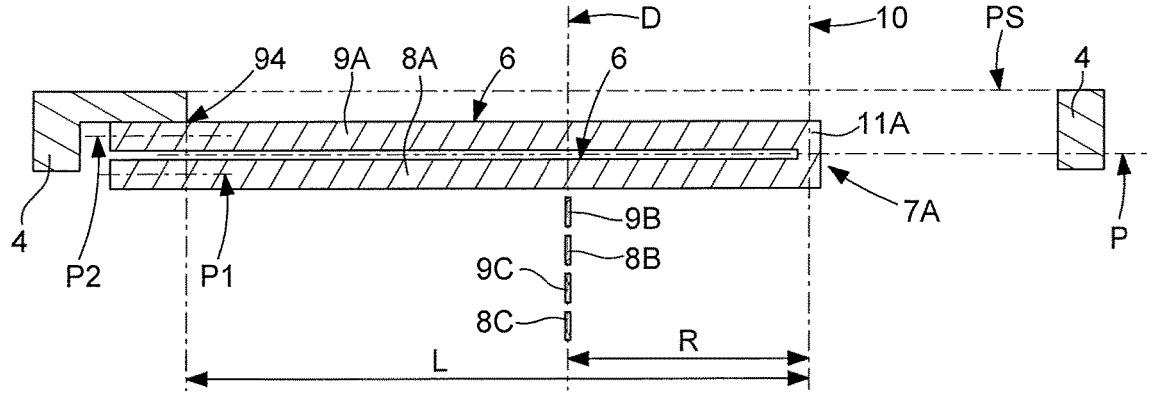
FIG. 10 is a section that illustrates, in a similar manner to FIG. 3 and in the plane of the upper flexible connection, another variant wherein the inertia element does not extend on both sides of the set of elastic strips, but only on the side of the upper elastic strip.
Figure 11:
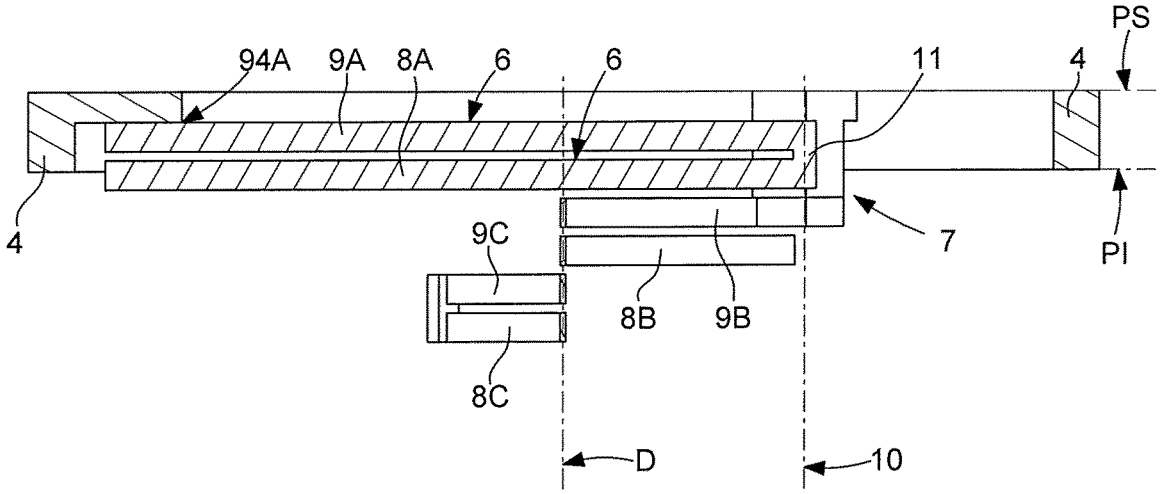
FIG. 11 is a sectional view of the variant of FIG. 10 through the same plane and in which the three flexible connections are visible.
Figure 12:
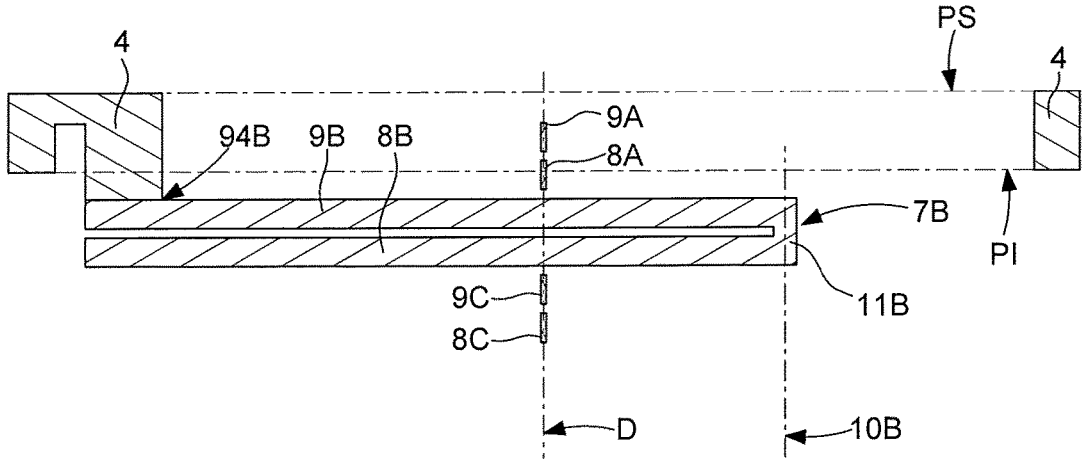
FIG. 12 is a section of the variant of FIG. 10, in the plane of the intermediate flexible connection.

In the advantageous embodiment of FIGS. 1, 2 and 9, oscillator 100 includes, on a same level in the direction of virtual pivot axis D, three identical flexible connections 5 at 120° from each other. In this configuration, the ratio R/L between, on the one hand, the eccentricity R of apex 10 relative to virtual pivot axis D, in projection onto plane of pivoting P, and on the other hand, the shortest length L between apex 10 and first end 82 or second end 94, in projection onto plane of pivoting P, is comprised between 0.12 and 0.18, or between 0.47 and 0.53. Elastic strips 6 are made of silicon and/or silicon dioxide, and each have a length of 1.00 mm, a height of 0.15 mm, a thickness of 25.8 micrometres and a value $\lambda$=R/L of −0.496.

The Figures illustrate different variants comprising three flexible connections superposed in this manner, arranged at 120° in projection onto plane P: upper compass 7A with first upper arm 8A and second upper arm 9A, intermediate compass 7B with first intermediate arm 8B and second intermediate arm 9B, lower compass 7C with first lower arm 8C and second lower arm 9C.

In particular, oscillator 100 includes, on a same level in the direction of virtual pivot axis D, an odd number of flexible connections 5, which are preferably identical to facilitate self-starting of the oscillator.

Generally, the dimensions suitable for such elastic strips 6 for watch oscillators are: length from 0.50 to 4.00 mm, height from 0.10 to 0.50 mm, thickness from 10 to 40 micrometres, and R/L comprised between 0.10 and 0.20 or between 0.45 and 0.55, and more particularly between 0.12 and 0.18, or between 0.47 and 0.53.

Figure 4:
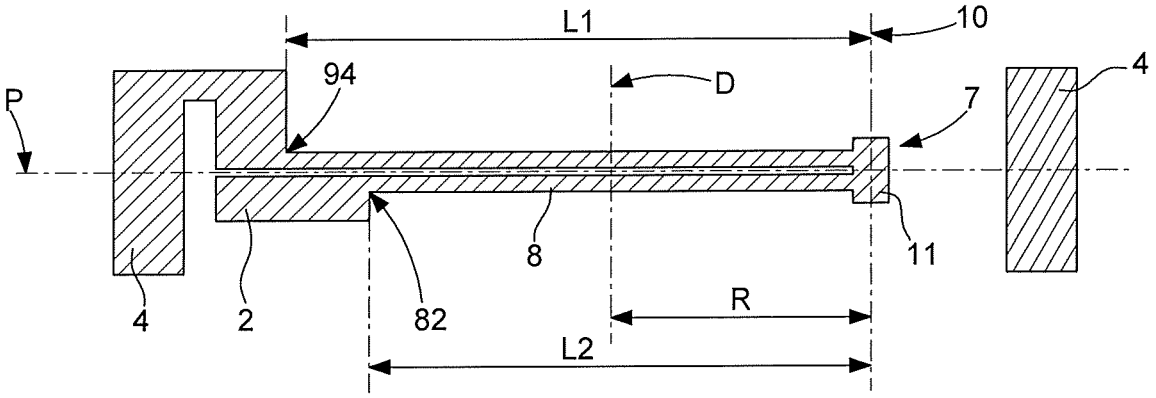
FIG. 4 illustrates, in a similar manner to FIG. 3, another variant, wherein the useful lengths are different, the projections of the strips onto the plane of pivoting are only identical over one portion, which includes the top of the compass, and extends on both sides of the virtual pivot axis defined by the flexible connections.
Figure 5:
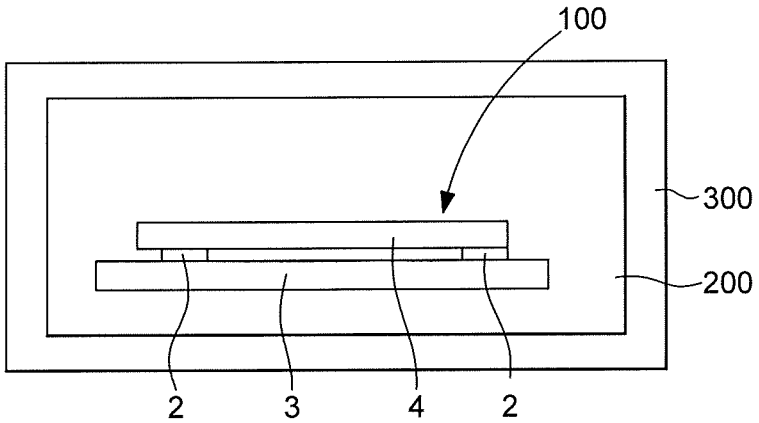
FIG. 5 is a block diagram which represents a watch comprising a timepiece movement, which includes a mechanical oscillator, and a bottom plate or a bridge for attachment of each said base comprised in this oscillator.
Figure 6:
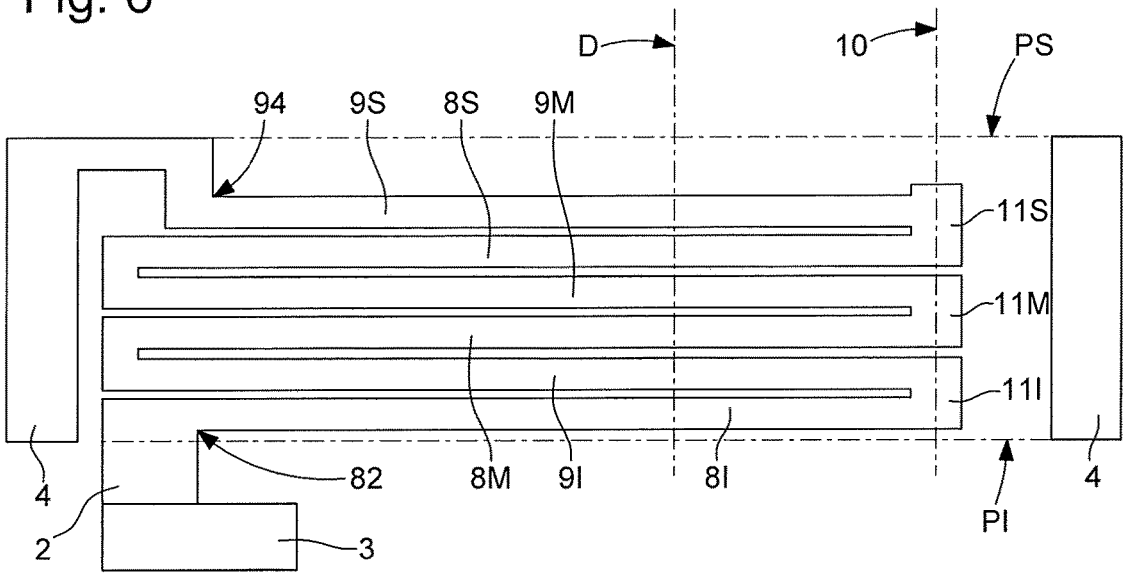
FIG. 6 illustrates, in a similar manner to FIG. 3, another variant, wherein a same flexible connection includes a superposition of six elastic strips, here forming three deformable compass-like members.
Figure 7:
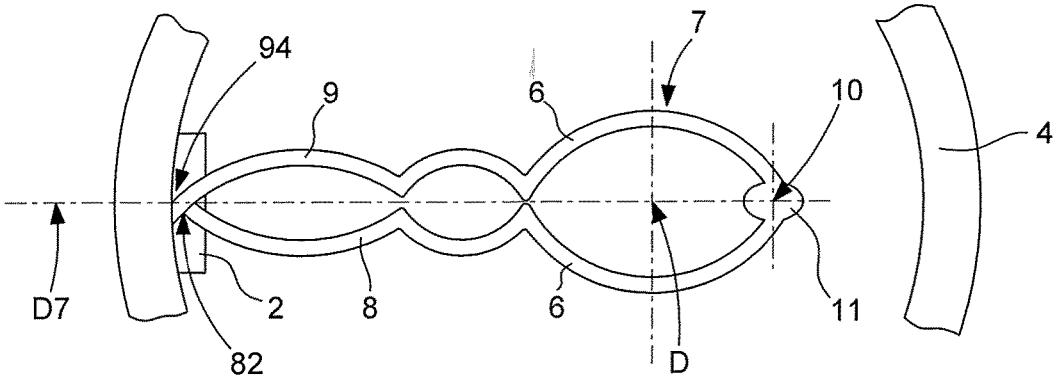
FIG. 7 illustrates, in a similar manner to FIG. 2, a detail of another variant, wherein the elastic strips that form the flexible connections are not straight but symmetrical only with respect to a compass axis passing through the top of the compass-like member and the virtual pivot axis, in projection onto the plane of pivoting.

FIG. 4 illustrates a particular case where the useful lengths of elastic strips 6 are different, the strip projections onto plane of pivoting P are only identical over one portion, which includes compass apex 10, and extends on both sides of virtual pivot axis D defined by flexible connections 5. Non-symmetrical arms can also be envisaged, for example of different thickness, of different shape, or otherwise.

FIG. 9 illustrates another variant where the elastic strips that form the flexible connections are not straight, but only symmetrical with respect to a compass axis passing through the compass top and the virtual pivot axis, in projection onto the plane of pivoting. There is no limitation as to shape, the strips could be in treble clef shape or any shape allowing the strip length to extend, such as a spiral or otherwise.

Each said flexible connection 5 can be made of silicon and/or silicon dioxide, or of an at least partially amorphous material, or DLC, or quartz or similar materials.

The invention also concerns a timepiece movement 200 comprising a least one such mechanical oscillator 100 and comprising a bottom plate 3 or a bridge for securing each base 2 comprised in each oscillator 100.

The invention also concerns a watch 300 including at least one such timepiece movement 200, and/or including at least one such mechanical oscillator 100.

Of course, it is possible to vary:

the number of flexible connections;

the number of pairs of elastic strips per flexible connection;

the angle between the elastic strips of the flexible connections;

the ratio R/L;

the inertia blocks by adding at least one stiff part to the elastic strips.

The invention claimed is:

1. A mechanical timepiece oscillator including at least one base arranged to be fixed to a bottom plate or a bridge of a timepiece movement, and at least one inertia element arranged to oscillate about a virtual pivot axis of fixed position with respect to said at least one base or of fixed position with respect to said bases when said oscillator has several, in a plane of pivoting perpendicular to said virtual pivot axis, each said inertia element being suspended to at least one said base by several flexible connections each including at least one elastic strip, and said flexible connections together defining said virtual pivot axis, wherein at least one said flexible connection includes at least one deformable compass-like member comprising said elastic strip forming a first arm arranged, at a first end, to be fixed to said base or integral with said base, angularly movable, in projection onto said plane of pivoting, with respect to another said elastic strip forming a second arm of said deformable compass-like member which, at a second end, is arranged to be fixed to said inertial element, or integral with said inertia element, said first arm and said second arm being joined at a reversal edge defining a virtual apex of said deformable compass-like member, a straight line forming a compass axis joining said virtual pivot axis and the projection of said virtual apex onto said plane of pivoting, and wherein, in an unstressed rest state of said oscillator, the projection of said virtual apex onto a plane defined by said virtual pivot axis and said compass axis is on a first side of said virtual pivot axis, opposite to a second side where said first end and said second end are projected.

2. The mechanical oscillator according to claim 1, wherein, in said unstressed rest state of said oscillator, the angle formed by the projection, onto said plane of pivoting, of said virtual apex, of said virtual pivot axis, and of said first end and/or of said second end, is comprised between 160° and 200°.

3. The mechanical oscillator according to claim 1, wherein, in said unstressed rest state of said oscillator, the projections onto said plane of pivoting of said first end and of said second end are coincident.

4. The mechanical oscillator according to claim 1, wherein said first arm and said second arm are symmetrical, in projection onto said plane of pivoting, with respect to said compass axis.

5. The mechanical oscillator according to claim 1, wherein the ratio R/L between, on the one hand, the eccentricity R of said apex relative to said virtual pivot axis, in projection onto said plane of pivoting, and on the other hand, the shortest length L between said apex and said first end or said second end, in projection onto said plane of pivoting, is comprised between 0.12 and 0.18, or between 0.47 and 0.53.

6. The mechanical oscillator according to claim 1, wherein all of said compass axes of all of said deformable compass-like members comprised in a same flexible connection are coincident in projection onto said plane of pivoting.

7. The mechanical oscillator according to claim 1, wherein all of said compass axes of all of said deformable compass-like members comprised in said flexible connections intersect, in projection onto said plane of pivoting, on said virtual pivot axis.

8. The mechanical oscillator according to claim 1, wherein all of said first flexible connections are identical.

9. The mechanical oscillator according to claim 1, wherein all of said compass axes of all of said deformable compass-like members comprised in said flexible connections are uniformly angularly distributed about said virtual pivot axis.

10. The mechanical oscillator according to claim 1, wherein at least one said deformable compass-like member includes said elastic strips which are straight in said unstressed rest state of said oscillator.

11. The mechanical oscillator according to claim 10, wherein all of said first strips are straight.

12. The mechanical oscillator according to claim 1, wherein at least one said deformable compass-like member has said first arm in a first level parallel to said plane of pivoting, and said second arm in a second level parallel to said plane of pivoting and distinct from said first level.

13. The mechanical oscillator according to claim 12, wherein each said deformable compass-like member has said first arm in a first level parallel to said plane of pivoting, and said second arm in a second level parallel to said plane of pivoting and distinct from said first level.

14. The mechanical oscillator according to claim 1, wherein at least one said deformable compass-like member includes said first arm and said second arm whose projections onto said plane of pivoting, in said unstressed rest state of said oscillator, are superposed on each other.

15. The mechanical oscillator according to claim 14, wherein said projections of said first arm and of said second arm of each deformable compass-like member, onto said plane of pivoting, in said unstressed rest state of said oscillator, are identical to each other.

16. The mechanical oscillator according to claim 14, wherein each said deformable compass-like member includes said first arm and said second arm whose projections onto said plane of pivoting, in said unstressed rest state of said oscillator, are superposed on each other.

17. The mechanical oscillator according to claim 1, wherein at least one said deformable compass-like member has said first arm which is stiffer than said second arm and less stiff than said inertia element fixed to the second end thereof.

18. The mechanical oscillator according to claim 17, wherein each said deformable compass-like member has said first arm which is stiffer than said second arm and less stiff than said inertia element fixed to the second end thereof.

19. The mechanical oscillator according to claim 1, wherein at least one said deformable compass-like member has said first arm which is as stiff as said second arm and has the same elastic characteristics, and which is less stiff than said inertia element fixed to the second end thereof.

20. The mechanical oscillator according to claim 19, wherein each said deformable compass-like member has said first arm which is as stiff as said second arm and has the same elastic characteristics, and which is less stiff than said inertia element fixed to the second end thereof.

21. The mechanical oscillator according to claim 1, wherein at least one said inertia element extends in the direction of said virtual pivot axis on both sides of the set of said flexible connections via which it is suspended to said base or to said bases.

22. The mechanical oscillator according to claim 1, wherein each said inertia element extends in the direction of said virtual pivot axis on both sides of the set of said flexible connections via which it is suspended to said base or to said bases.

23. The mechanical oscillator according to claim 1, wherein at least one said inertia element is devoid of an axial bearing and is devoid of a radial bearing, with respect to said virtual pivot axis, other than said flexible connections via which it is suspended to said base or to said bases.

24. The mechanical oscillator according to claim 1, wherein each said inertia element is devoid of an axial bearing and is devoid of a radial bearing, with respect to said virtual pivot axis, other than said flexible connections via which it is suspended to said base or to said bases.

25. The mechanical oscillator according to claim 1, wherein at least one said deformable compass-like member includes at least one intermediate inertia block, which is stiffer than said first arm and said second arm, on said first arm and/or on said second arm (9) and/or on said reversal edge.

26. The mechanical oscillator according to claim 1, wherein said oscillator includes, on three parallel levels in the direction of said virtual pivot axis, three identical said flexible connections at 120° from each other in projection onto said plane of pivoting, said three flexible connections, thus superposed, comprise in succession an upper compass-like member with a first upper arm and a second upper arm, an intermediate compass-like member with a first intermediate arm and a second intermediate arm, and a lower compass-like member with a first lower arm and a second lower arm.

27. The mechanical oscillator according to claim 1, wherein each said flexible connection is made of silicon and/or silicon dioxide, or of an at least partially amorphous material, or of DLC, or of quartz.

28. A timepiece movement comprising:

at least one of the mechanical oscillator according to claim l; and a bottom plate or a bridge for securing each said base comprised in each said oscillator.

29. A watch comprising:

at least one of the timepiece movement according to claim 28.

* * * * *